US008837744B2

(12) United States Patent
Yonekubo et al.

(10) Patent No.: US 8,837,744 B2
(45) Date of Patent: Sep. 16, 2014

(54) SOUND QUALITY CORRECTING APPARATUS AND SOUND QUALITY CORRECTING METHOD

(75) Inventors: Hiroshi Yonekubo, Suginami-ku (JP); Hirokazu Takeuchi, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 371 days.

(21) Appl. No.: 13/188,186

(22) Filed: Jul. 21, 2011

(65) Prior Publication Data

US 2012/0070016 A1 Mar. 22, 2012

(30) Foreign Application Priority Data

Sep. 17, 2010 (JP) ..... 2010-210078

(51) Int. Cl.

| | |
|---|---|
| ***H01R 29/00*** | (2006.01) |
| ***G10K 11/178*** | (2006.01) |
| ***H04R 3/04*** | (2006.01) |
| *H04R 1/02* | (2006.01) |

(52) U.S. Cl.

CPC ..... *G10K 11/1782* (2013.01); *G10H 2250/235* (2013.01); *H04R 1/028* (2013.01); *G10H 2210/046* (2013.01); *H04R 3/04* (2013.01)

USPC ..... 381/56; 381/94.2; 704/211

(58) Field of Classification Search

USPC ..... 704/211–216

See application file for complete search history.

(56) References Cited

U.S. PATENT DOCUMENTS

| | | | | |
|---|---|---|---|---|
| 5,298,674 | A * | 3/1994 | Yun | 84/616 |
| 6,570,991 | B1 * | 5/2003 | Scheirer et al. | 381/110 |
| 2009/0046873 | A1 * | 2/2009 | Riedl | 381/107 |
| 2010/0158261 | A1 * | 6/2010 | Takeuchi et al. | 381/56 |

FOREIGN PATENT DOCUMENTS

| | | |
|---|---|---|
| JP | 2009-175473 | 8/2009 |
| JP | 2010-014960 | 1/2010 |
| JP | 2010-152015 | 7/2010 |

* cited by examiner

*Primary Examiner* — Joseph Saunders, Jr.
*Assistant Examiner* — James Mooney
(74) *Attorney, Agent, or Firm* — Blakely, Sokoloff, Taylor & Zafman LLP

(57) ABSTRACT

A sound quality correcting apparatus includes: an input module; a feature quantity calculator; a score calculator; a modulation spectrum power calculator; a score corrector; and a signal corrector. The input module receives an input audio signal. The feature quantity calculator calculates feature quantities of the input audio signal for each of a plurality of first intervals having a certain time length. The score calculator calculates a score value for each the first interval based on the feature quantities. The modulation spectrum power calculator calculates a power value, at a certain modulation frequency, of a modulation spectrum of the input audio signal. The score corrector corrects score values in the plurality of first intervals that belong to a second interval if a power value calculated in the second interval is larger than or equal to a certain value. The signal corrector corrects the audio signal based on the score values.

20 Claims, 6 Drawing Sheets

SOUND QUALITY CORRECTING APPARATUS AND SOUND QUALITY CORRECTING METHOD

CROSS-REFERENCE TO RELATED APPLICATION(S)

The application is based upon and claims the benefit of priority from Japanese Patent Application No. 2010-210078 filed on Sep. 17, 2010; the entire content of which are incorporated herein by reference.

FIELD

Embodiments described herein relate generally to a sound quality correcting apparatus and a sound quality correcting method.

BACKGROUND

There are a broadcast receiver for receiving a TV broadcast and a player for replaying data recorded in a recording medium. In replaying and outputting an audio signal of a received TV broadcast or data recorded in a recording medium in these apparatus, it is preferable to correct sound quality of the audio signal so that a high-quality audio signal can be output.

When correcting sound quality of audio signal, it is preferable to perform a correction that is suitable for the content of the audio signal.

DETAILED DESCRIPTION OF THE EMBODIMENTS

In general, according to one exemplary embodiment, a sound quality correcting apparatus is provided. The apparatus includes: an input module; a feature quantity calculator; a score calculator; a modulation spectrum power calculator; a score corrector; and a signal corrector. The input module is configured to receive an input audio signal. The feature quantity calculator is configured to calculate feature quantities of the input audio signal for each of a plurality of first intervals having a certain time length. The score calculator is configured to calculate a score value for each of the plurality of first intervals based on the calculated feature quantities. The modulation spectrum power calculator is configured to calculate a power value, at a certain modulation frequency, of a modulation spectrum of the input audio signal. The score corrector is configured to correct score values in the plurality of first intervals that belong to a second interval if a power value calculated in the second interval is larger than or equal to a certain value. The signal corrector is configured to correct the audio signal based on the corrected score values.

First Embodiment

A first embodiment will be hereinafter described with reference to the drawings.

Figure 1:
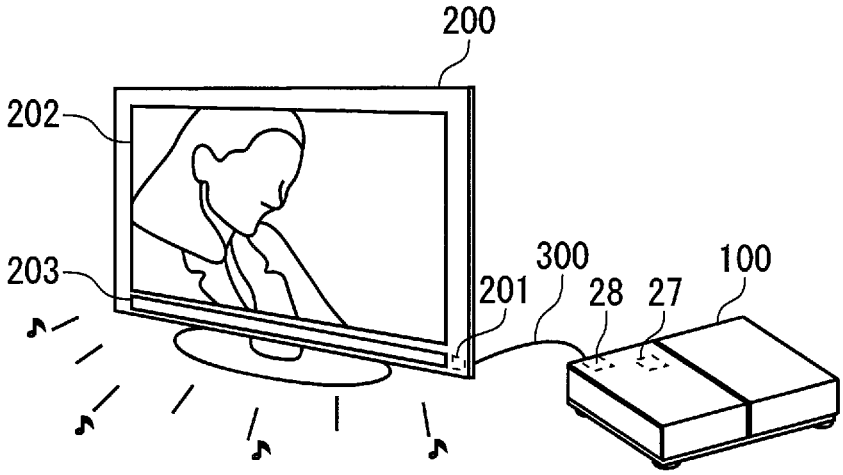
FIG. 1 shows an example use form of a receiver according to a first embodiment.

FIG. 1 shows an example use form of a receiver 100 which is a sound quality correcting apparatus according to the first embodiment. The receiver 100 is connected to a display/speaker apparatus 200 via a digital interface 300.

The receiver 100 is provided with tuners 15, 20, and 23 (not shown in FIG. 1), an audio processor 27, a video/audio output module 32, etc. The display/speaker apparatus 200 is provided with a video/audio input module 201, a speaker unit 203, etc.

The tuners 15, 20, and 23 receive TV broadcast signals. The audio processor 27 corrects an audio signal of the broadcast signal received by each of the tuners 15, 20, and 23. The video/audio output module 32 outputs the corrected audio signal to the display/speaker apparatus 200 via the digital interface 300. The speaker unit 203 of the display/speaker apparatus 200 outputs a sound of the audio signal that is input to the video/audio input module 201.

In correcting an audio signal, the audio processor 27 can perform a correction of the audio signal that is suitable for the content of the audio signal. The audio signal may include intervals with a playing sound of a song, intervals with a playing sound and a singing voice, intervals with a playing sound and a human talking voice, etc. The receiver 100 according to the embodiment can detect an interval with a human talking voice and perform a sound quality correction that is suitable for that interval. The details will be described later with reference to FIGS. 2 to 5.

Figure 2:
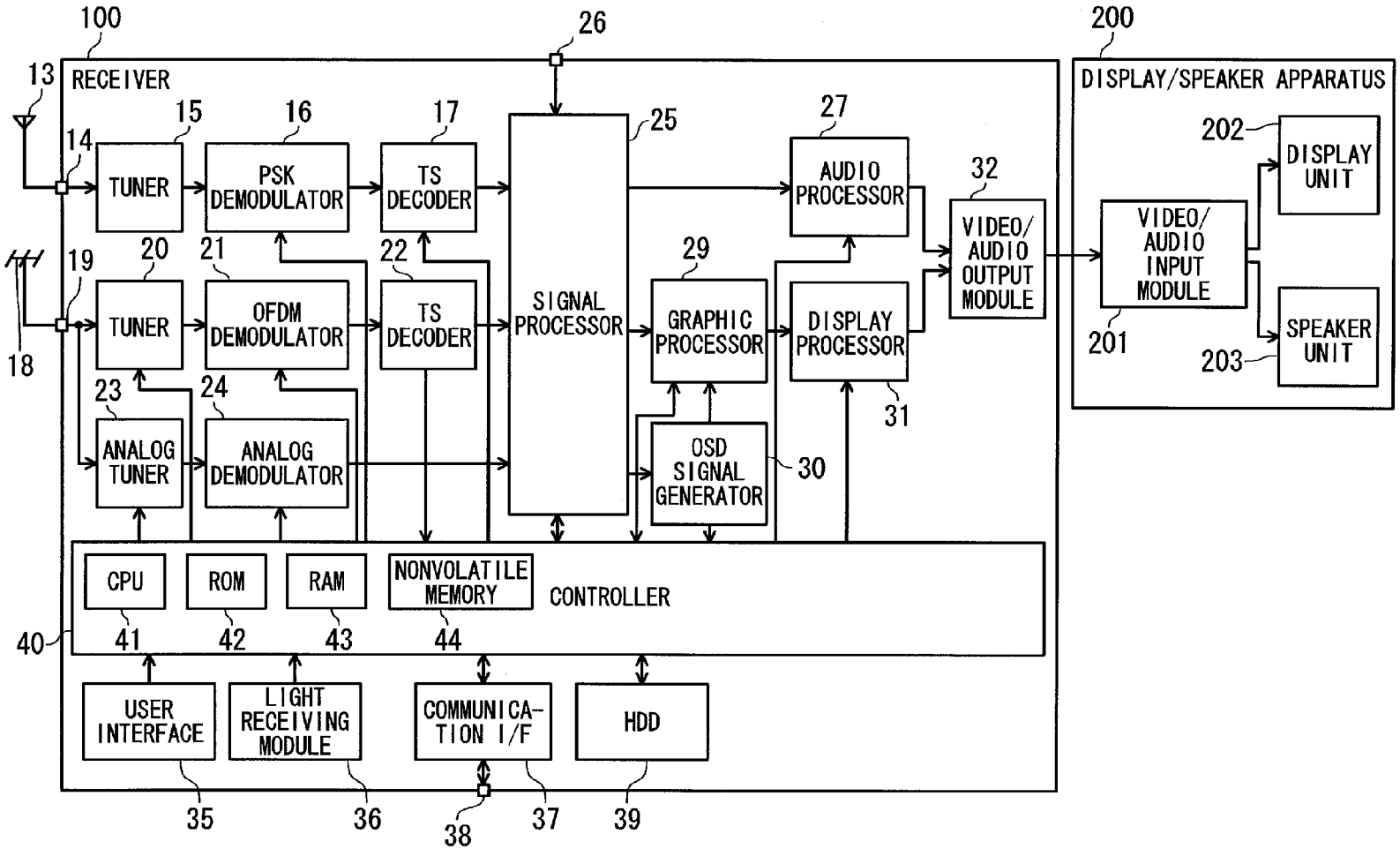
FIG. 2 a block diagram showing example system configurations of the receiver according to the first embodiment and a display/speaker apparatus.

Next, example system configurations of the receiver 100 and the display/speaker apparatus 200 will be described with reference to FIG. 2.

The receiver 100 is provided with an input terminal 14, the tuner 15, a PSK demodulator 16, a TS decoder 17, an input terminal 19, the tuner 20, an OFDM demodulator 21, a TS decoder 22, the analog tuner 23, an analog demodulator 24, a signal processor 25, an input terminal 26, an audio processor 27, a graphic processor 29, an OSD signal generator 30, a display processor 31, the video/audio output module 32, a user interface 35, a light receiver 36, a communication interface (I/F) 37, a connector 38, an HDD 39, a controller 40, etc. The controller 40 is provided with a CPU 41, a ROM 42, a RAM 43, a nonvolatile memory 44, etc.

The input terminal 14 is connected to a broadcasting satellite (BS)/communication satellite (CS) digital broadcast receiving antenna 13. Satellite digital TV broadcast signals received by the antenna 13 are input to the input terminal 14.

The satellite digital broadcast tuner 15 tunes in to one of the broadcast signals that are input to the input terminal 14. The broadcast signal selected by the tuner 15 is demodulated by the phase shift keying (PSK) demodulator 16 into a digital video signal and audio signal, which are decoded by the transport stream (TS) decoder 17. The resulting decoded digital video signal and audio signal are supplied to the signal processor 25.

Terrestrial digital TV broadcast signals received by the terrestrial broadcast receiving antenna 18 are input to the input terminal 19. The terrestrial digital broadcast tuner 20 tunes in to one of the broadcast signals that are input to the input terminal 19. In Japan, for example, the broadcast signal selected by the tuner 20 is demodulated by the OFDM (orthogonal frequency division multiplexing) demodulator 21 into a digital video signal and audio signal, which are decoded by the TS decoder 22. The resulting decoded digital video signal and audio signal are supplied to the signal processor 25.

Terrestrial analog TV broadcast signals received by the terrestrial broadcast receiving antenna 18 are input to the terrestrial analog broadcast analog tuner 23 via the input terminal 19. A broadcast signal selected by the analog tuner 23 is demodulated by the analog demodulator 24 into an analog video signal and audio signal, which are supplied to the signal processor 25.

The signal processor 25 performs certain digital signal processing on each of the sets of a digital video signal (data) and audio signal (data) that are input from the TS decoders 17 and 22 and outputs a resulting digital video signal and audio signal to the graphic processor 29 and the audio processor 27, respectively. The signal processor 25 likewise performs signal processing on a video signal and an audio signal that are input from the controller 40, and outputs the resulting video signal and audio signal.

The input terminal(s) 26 is connected to the signal processor 25. For example, plural input terminals 26 are provided and each of them allows input of an analog video signal and audio signal from outside the receiver 100. The signal processor 25 digitizes each of the sets of a digital video signal and audio signal that are input from the analog demodulator 24 and the input terminal(s) 26, performs certain digital signal processing on a resulting digital video signal and audio signal, and outputs resulting digital video signal and audio signal to the graphic processor 29 and the audio processor 27, respectively.

The audio processor 27 performs sound quality correction processing (described later) on the digital audio signal that is input from the signal processor 25, converts the corrected audio signal into an audio signal having such a format as to be able to be output from speakers, and outputs the latter audio signal to the video/audio output module 32.

The graphic processor 29 has a function of superimposing an on-screen display (OSD) signal generated by the OSD signal generator 30 on a digital video signal that is input from the signal processor 25. The graphic processor 29 can also output a selected one of the digital video signal that is input from the signal processor 25 and the OSD signal that is input from the OSD signal generator 30.

The display processor 31 converts the received digital video signal into a video signal having such a format as to be displayable by a display device, and outputs the latter video signal to the video/audio output module 32.

The video/audio output module 32 outputs each of the audio signal that is input from the audio processor 27 and the video signal that is input from the display processor 31 to the display/speaker apparatus 200 via the digital interface 300.

The user interface 35 is an operation input device such as an operating panel for receiving an operation from the user. The light receiving module 36 receives an operation signal from an operation input device such as a remote controller (not shown). Each of the user interface 35 and the light receiving module 36 outputs information indicating the received operation to the controller 40.

The communication I/F 37 communicates with an external apparatus that is connected to the connector 38. The communication I/F 37 performs a general LAN communication according to Ethernet (registered trademark) or performs a USB communication. For example, a storage device such as an HDD, a PC, or a replaying apparatus such as a DVD recorder is connected to the connector 38. The communication I/F 37 can be connected to a network such as the Internet via the connector 38. The communication I/F 37 can output, to the signal processor 25, via the controller 40, a video signal (data) and/or an audio signal (data) that is input from the external apparatus via the connector 38.

The HDD 39 has a function of storing video/audio data. For example, the HDD 39 stores TV broadcast video/audio data received by any of the tuners 15, 20, and 23, etc. and video/audio data that is input to the communication I/F 37.

Provided with the CPU (central processing unit) 41, the ROM (read-only memory) 42, the RAM (random access memory) 43, and the nonvolatile memory 44, the controller 40 controls the individual sections etc. of the receiver 100 and thereby controls various kinds of operations. In controlling each of the various kinds of operations, the CPU 41 reads control programs from the ROM 42 and uses the RAM 43 as a work area. The CPU 41 also reads various kinds of setting information and control information etc. from the nonvolatile memory 44.

For example, the controller 40 receives operation information that is input from the user interface 35 or operation information that is transmitted from the operation input device such as a remote controller (not shown) and received by the light receiving module 36 and controls individual sections etc. of the receiver 100 according to the content of the received operation information.

The controller 40 can store video/audio data in the HDD 39, and read stored data from the HDD 39 and output the read-out data to the signal processor 25. Furthermore, the controller 40 outputs, to the signal processor 25, video/audio data that is input to the communication I/F 37.

Next, the example system configuration of the display/speaker apparatus 200 will be described. The display/speaker apparatus 200 is provided with the video/audio input module 201, a display unit 202, the speaker unit 203, etc. A video signal and an audio signal are input from the receiver 100 to the video/audio input module 201 via the digital interface 300. The video/audio input module 201 outputs the received video signal and audio signal to the display unit 202 and the speaker unit 203, respectively. The display unit 202 displays video based on the received video signal, and the speaker unit 203 outputs a sound based on the received audio signal.

Figure 3:
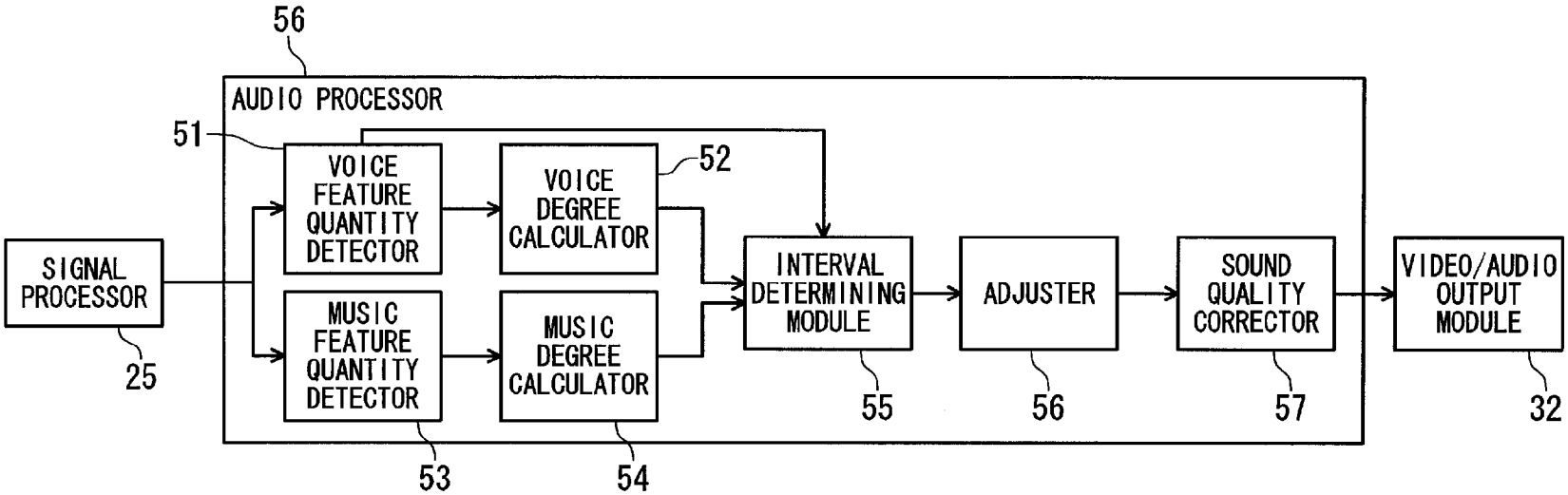
FIG. 3 is a block diagram showing an example functional configuration of an audio processor of the receiver according to the first embodiment.

FIG. 3 is a block diagram showing an example functional configuration of the audio processor 27. The audio processor 27 is provided with a voice feature quantity detector 51, a voice degree calculator 52, a music feature quantity detector 53, a music degree calculator 54, an interval determining module 55, an adjuster 56, a sound quality corrector 57, etc.

The voice feature quantity detector 51 receives an audio signal from the signal processor 25. The voice feature quantity detector 51 detects feature quantities relating to a human voice sound component, for example, from the input audio signal. First, the voice feature quantity detector 51 cuts the input audio signal into frames each having an interval of several hundreds of milliseconds, for example. The voice feature quantity detector 51 further divides each audio signal frame into sub-frames of several tens of milliseconds.

The voice feature quantity detector 51 detects values of various parameters of the audio signal on a sub-frame basis. For example, the voice feature quantity detector 51 detects values of parameters that enable detection of a human voice, such as a power value which is the sum of the squares of amplitudes of the audio signal and a zero-cross frequency which is the number of times per unit time in which the time waveform of the audio signal crosses zero in the amplitude direction.

The voice feature quantity detector 51 calculates, for each frame, statistical quantities such as an average, a variance, a maximum value, and a minimum value of each of the detected parameter values and employs the calculated statistical quantities as feature quantities. The voice feature quantity detector 51 may detect values of other parameters as feature quantities.

The characteristics of each parameter will be described below. For example, in a human voice interval, utterance intervals and silent intervals may occur alternately. Therefore, sub-frame amplitude power values of an audio signal tend to have a large variance. A voice interval can be detected by detecting a variance of power values. On the other hand, in a human voice, vowel sounds have low zero-cross frequencies and consonant sounds have high zero-cross frequencies. Therefore, sub-frame zero-cross frequencies tend to have a large variance.

The voice feature quantity detector 51 detects (calculates) a modulation spectrum as a feature quantity for discrimination of voice intervals of an input audio signal. The term "voice interval" means, among time intervals of an audio signal, an interval that includes a signal of a human voice such as a speech or a conversation. The term "modulation spectrum" means a spectrum that represents periodicity of a temporal variation of the power value of a certain frequency component (or certain frequency range).

In a human voice, the power value of a voice frequency component in a band that is lower than 8 kHz, for example, varies at a cycle of about 4 Hz. However, in many cases, the power value variation of a singing voice, which is a kind of human voice, does not have such a cycle. Therefore, in an input audio signal, an ordinary voice interval and a singing voice interval can be discriminated from each other by detecting the periodicity of a power value variation of a certain frequency component of the audio signal based on the modulation spectrum.

It is appropriate for the voice feature quantity detector 51 to calculate a modulation spectrum (periodicity of a power value variation) of a frequency component that enables recognition of a human voice. The cycle of a power value variation of such a frequency component is not necessarily equal to about 4 Hz and may varies in a range of 2 to 10 Hz. However, in many cases, the power value of such a frequency component varies at a cycle of about 4 Hz.

In detecting a modulation spectrum, first, the voice feature quantity detector 51 calculates a frequency power spectrum of an input audio signal by performing Fourier transform on a time waveform in a certain time interval of the audio signal. Then, the voice feature quantity detector 51 calculates a power spectrum representing a time variation of the power value of a certain frequency component based on frequency power spectra in plural consecutive intervals. Then, the voice feature quantity detector 51 calculates a modulation spectrum which represents periodicity of a time variation of the power value of the certain frequency component by performing Fourier transform on the calculated power spectrum.

For example, the voice feature quantity detector 51 calculates frequency power spectra of an audio signal by performing Fourier transform on it on a sub-frame basis, for example. Then, the voice feature quantity detector 51 calculates modulation spectra on a frame-by-frame basis by performing Fourier transform on temporal loci of the frequency power spectra. The voice feature quantity detector 51 outputs the calculated modulation spectra to the interval determining module 55.

In calculating each modulation spectrum, the voice feature quantity detector 51 converts a frequency power spectrum calculated by Fourier-transforming an audio signal into a power spectrum of, for example, the "mel scale" which is a frequency scale suitable for analysis of a human auditory frequency component. Then, the voice feature quantity detector 51 analyzes the mel-scale power spectrum using plural triangular-wave filter banks and thereby calculates mel-scale power spectra in plural respective bands.

In general, human voices are in a frequency band that is lower than about 8 kHz. Therefore, the voice feature quantity detector 51 performs the mel scale conversion and the triangular-wave filter bank analysis on part, in the band that is lower than about 8 kHz, of a frequency power spectrum calculated by Fourier transform. The voice feature quantity detector 51 calculates a modulation spectrum based on power spectra obtained by the mel scale conversion and the filter bank analysis.

The voice degree calculator 52 calculates a human voice degree (i.e., degree of dominance of a human voice component) of the input audio signal based on the values of the various feature quantity parameters detected by the voice feature quantity detector 51. The voice degree calculator 52 generates a voice score representing the voice degree and outputs the generated voice score to the interval determining module 55.

A method for determining a voice degree in the voice degree calculator 52 will be described below. The voice degree calculator 52 calculates a voice degree using a linear discrimination function, for example. That is, a voice score S1 is calculated according to, for example, the following linear discrimination function.

$$S1=A0+A1\cdot X1+A2\cdot X2+\ldots+An\cdot Xn$$

where X1-Xn are the various feature quantity parameters detected by the voice feature quantity detector 51 and A0 to An are weight coefficients for the respective feature quantity parameters. The weight coefficients A0 to An are such that a coefficient corresponding to a feature quantity parameter that reflects a feature of a human voice more strongly is given a larger value. For example, the weight coefficients A0 to An are calculated by learning the feature quantity parameters using, as reference data, audio signals each of whose content is known.

Each of the weight coefficients A0 to An may be such that the voice score S1 has a value in a range of 0 to 1 according to input feature quantity parameter values. The method for determining a voice degree in the voice degree calculator 52 is not limited to the above one. For example, it may be a Gaussian mixture models (GMM) method. Or different discrimination formulae may be used depending on the number of channels of an input audio signal.

The music feature quantity detector 53 receives an audio signal from the signal processor 25. The music feature quantity detector 53 detects feature quantities relating to a sound component of music such as a song or background music (BGM) from the input audio signal. Like the voice feature quantity detector 51, the music feature quantity detector 53 cuts the input audio signal into frames each having an interval of several hundreds of milliseconds, for example. The music feature quantity detector 53 further divides each audio signal frame into sub-frames of several tens of milliseconds.

The music feature quantity detector 53 detects values of various parameters of the audio signal on a sub-frame basis.

For example, the music feature quantity detector 53 detects values of parameters such as a power value in a certain frequency band of the Fourier transform of the audio signal, an LR power ratio of a stereo audio signal, and pitch information of the Fourier transform of the audio signal. The music feature quantity detector 53 calculates, for each frame, statistical quantities such as an average, a variance, a maximum value, and a minimum value of each of the detected parameter values and employs the calculated statistical quantities as feature quantities. The music feature quantity detector 53 may detect values of other parameters as feature quantities.

The characteristics of each parameter will be described below. For example, in an audio signal containing a playing sound of instruments etc., the amplitude power is in many cases concentrated in a particular frequency band depending on an instrument used in playing a song. Therefore, whether or not a playing sound component of a particular instrument is contained in an audio signal can be determined by detecting a power value in a certain frequency band of the Fourier transform of the audio signal.

In recording of music, in many cases, a playing sound of instruments (excluding a vocal sound) is localized at a position other than the center. Therefore, a stereo audio signal, for example, tends to have a large power ratio between the left and right channels. Whether or not an audio signal contains a playing sound of instruments can be determined by, for example, detecting a power ratio between an L-channel audio signal and an R-channel audio signal of a stereo audio signal.

In many cases, when an audio signal containing a playing sound of an instrument or the like has a component of a sound of a certain pitch, the audio signal also has a pitch that is one to several octaves higher or lower than the certain pitch (i.e., harmonics). Therefore, when a sound having a certain pitch is detected, whether or not an instrument is being played can be determined by detecting power values of harmonics of that sound. The term "harmonics" means sounds whose frequencies are approximately equal to integer multiples of the frequency of a certain sound.

The music degree calculator 54 calculates a musical sound degree (i.e., degree of dominance of a musical sound component in various sound components) of the input audio signal based on the values of the various feature quantity parameters detected by the music feature quantity detector 53. The music degree calculator 54 generates a music score representing the musical sound degree of the input audio signal and outputs the generated music score to the interval determining module 55.

Like the voice degree calculator 52, the music degree calculator 54 calculates a musical sound degree using a linear discrimination function, for example. For example, a music score S2 is calculated according to the following linear discrimination function:

$$S2=B0+B1\cdot Y1+B2\cdot Y2+\ldots+Bn\cdot Yn$$

where Y1-Yn are the various feature quantity parameters detected by the music feature quantity detector 53 and B0 to Bn are weight coefficients for the respective feature quantity parameters. The weight coefficients B0 to Bn are such that a coefficient corresponding to a feature quantity parameter that reflects a feature of a musical sound more strongly is given a larger value. For example, the weight coefficients B0 to Bn are calculated by learning the feature quantity parameters using, as reference data, audio signals each of whose content is known.

Each of the weight coefficients B0-Bn may be such that the music score S2 has a value in a range of 0 to 1 according to input feature quantity parameter values. The method for calculating a music degree in the music degree calculator 54 is not limited to the above one. For example, it may be a GMM (Gaussian mixture models) method. Or different discrimination formulae may be used depending on the number of channels of an input audio signal.

The interval determining module 55 determines whether or not plural frames belong to an interval in which a human voice exists based on modulation spectrum information that is input from the voice feature quantity detector 51. For example, the interval determining module 55 determines whether or not the power value of the modulation spectrum is larger than or equal to a threshold value in a certain modulation frequency range based on the modulation frequency information. The interval determining module 55 determines whether or not the power value of the modulation spectrum is larger than or equal to the threshold value at a modulation frequency of about 4 Hz, for example, or in a modulation frequency range of 2 to 10 Hz, for example.

If the power value of the modulation spectrum is larger than or equal to the threshold value in a certain number or more of frames among past P frames, the interval determining module 55 determines that the P frames belong to a human voice interval. The interval determining module 55 may determine that intervals following an interval that has been determined to be a voice interval are voice intervals even if the number of frames in which the power value of the modulation spectrum is larger than or equal to the threshold value is smaller than the certain number.

If determining that a certain interval is a voice interval, the interval determining module 55 sets a certain margin time m and determines that an interval is a voice interval if it is subjected to the voice interval/non-voice interval determination within the margin time m. Example voice interval determination processes will be described later with reference to FIG. 5.

The interval determining module 55 corrects each voice score S1 that is input from the voice degree calculator 52 and each music score S2 that is input from the music degree calculator 54 depending on whether or not the score-calculated interval is a voice interval. More specifically, for example, the interval determining module 55 corrects (reinforces) the voice score S1 that is calculated for each of the frames belonging to an interval that has been determined a voice interval by adding a certain value to it or multiplying it by a certain value.

If the score S1 or S2 calculated by the voice degree calculator 52 or the music degree calculator 54 were used as it is as degree information corresponding to a sound quality correction level for the audio signal, the following problem might occur. An audio signal of a broadcast program such as a drama has intervals in which a BGM sound and a line (voice) exist in mixture. If in such an interval only a musical sound element exists at a certain time point and only a voice element exists at another time point, the score that has been calculated according to the discrimination formula for the voice score S1 or the music score S2 may vary rapidly. A rapid variation of the score causes rapid switching of the sound quality correction for the audio signal, possibly producing a sound that is uncomfortable to the user.

In correcting an audio signal at a certain time point in an interval in which a BGM sound and a line exist in mixture, a rapid variation of the score can be prevented and the audio signal can be corrected smoothly if a line exists before that time point. In the receiver 100 according to the embodiment, a particular parameter that enables detection of a voice at a high probability is used after the calculation of a voice score S1 or a music score S2 so that the score that has been calculated according to the score discrimination formula can be adjusted (controlled) later.

In general, in intervals in which a musical sound element is dominant over a voice element, the voice element may be rendered indiscernible. In this case, in general, it is difficult to detect the voice element. However, it is highly probable that a power value at about 4 Hz of a modulation spectrum extracted in a band that is lower than 8 kHz enables detection of a voice even in an interval in which a musical sound is superimposed on the interval. Therefore, this parameter can suitably be used as a parameter for the above-described adjustment control.

The adjuster 56 adjusts the voice score S1 generated by the voice degree calculator 52 and the music score S2 generated by the music degree calculator 54. For example, the adjuster 56 smoothes out each of the frame-by-frame voice score S1 and music score S2 by calculating a moving average of score values of plural frames.

The sound quality corrector 57 corrects the audio signal based on the voice score and the music score as adjusted by the adjuster 56. For example, when receiving a voice score, the sound quality corrector 57 corrects the sound quality of the audio signal according to the received voice score so that it becomes suitable for a human voice. As described above, each of the voice score and the music score is in the range of 0 to 1. And the sound quality corrector 57 corrects the sound quality by a degree that corresponds to the score value in this range.

In correcting the sound quality of a stereo audio signal, for example, so that it becomes suitable for a human voice, the sound quality corrector 57 performs such a correction that a signal component that is localized at the center of the audio signal is emphasized. This is because in many cases a human voice signal of an on-the-spot broadcast of a sport program or a talk scene of a musical program is localized at the center of an audio signal of plural channels. Emphasizing a center signal component enables a sound quality correction that makes a voice signal clear.

The method of sound quality correction suitable for a voice is not limited to the above method; any correction method may be employed as long as it can correct the sound quality of a human voice component of an audio signal so that it becomes comfortable to the user. However, in any method, the sound quality corrector 57 corrects the sound quality by a degree that corresponds to the value of the received voice score.

When receiving a music score, the sound quality corrector 57 corrects the sound quality of the audio signal according to the received music score so that it becomes suitable for a musical sound. For example, the sound quality corrector 57 corrects the sound quality of an audio signal so that it becomes suitable for a musical sound by performing wide stereo processing, reverberation processing, or the like on the audio signal. The wide stereo processing is correction processing of adjusting each of L and R audio signals of a 2-channel stereo audio signal, for example, so that an output sound of the stereo audio signal from the speaker unit 203 gives the user a feeling of expanse. The reverberation processing is processing of correcting an audio signal so that its sound components are given a reverberation effect.

The method of sound quality correction suitable for a musical sound is not limited to the above method; any correction method may be employed as long as it can correct the sound quality of a musical sound component of an audio signal so that it becomes comfortable to the user. However, in any method, the sound quality corrector 57 corrects the sound quality by a degree that corresponds to the value of the received music score.

The sound quality corrector 57 outputs the corrected audio signal to the video/audio output module 32.

Next, an example sound quality adjusting operation performed by the audio processor 27 will be described with reference to FIG. 4.

Figure 4:
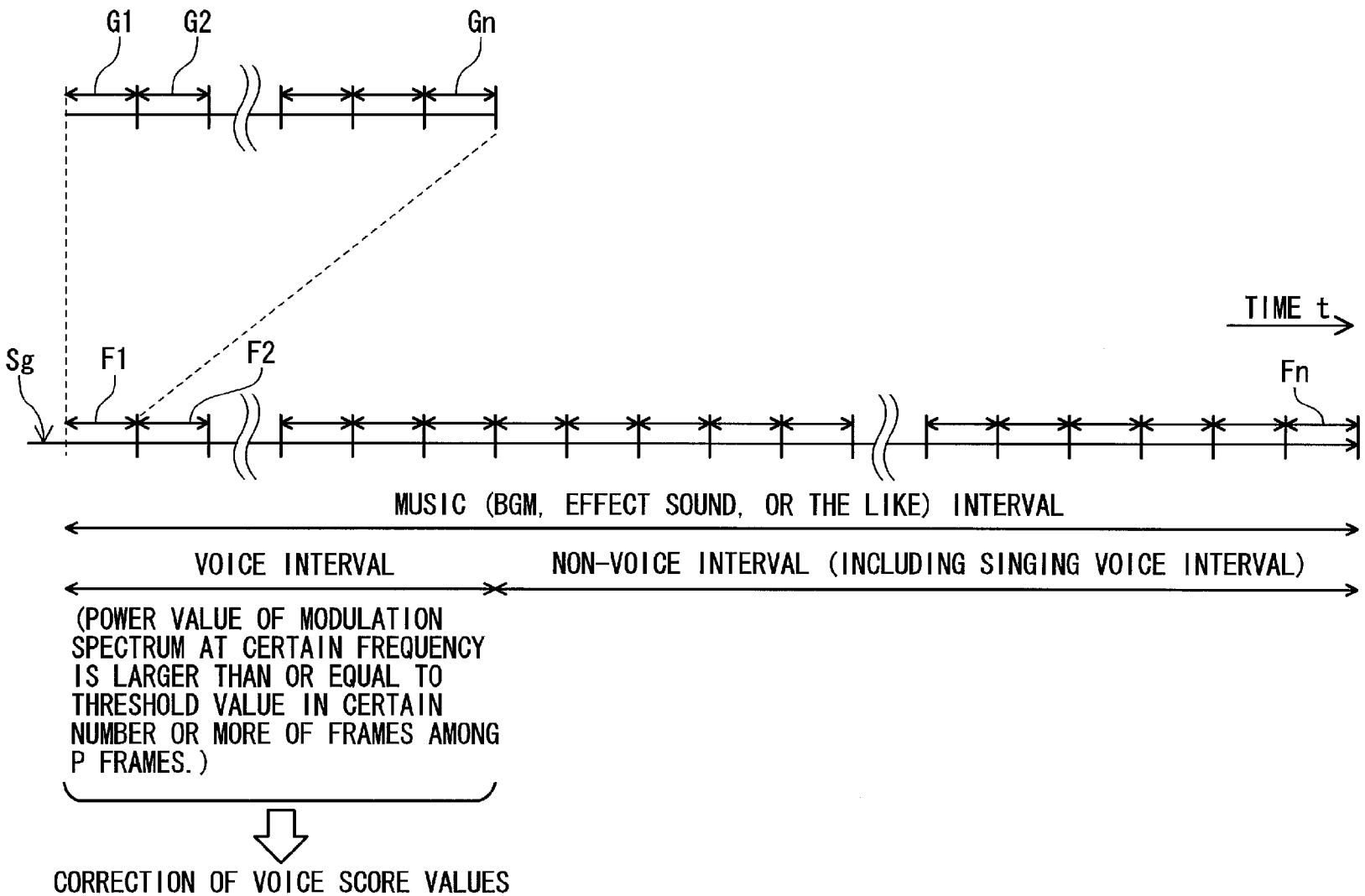
FIG. 4 shows an example sound quality adjusting operation performed by an audio processor of the receiver according to the first embodiment.

Referring to FIG. 4, an audio signal Sg is divided into frames F1-Fn each having a time length of several hundreds of milliseconds, for example. And each of the frames F1 to Fn is divided into sub-frames G1 to Gn each having a time length of several tens of milliseconds. Each of the voice feature quantity detector 51 and the music feature quantity detector 53 detects values of various parameters from each of the sub-frames G1 to Gn and calculates feature quantities of each frame based on the detected parameter values.

Then, each of the voice degree calculator 52 and the music degree calculator 54 calculates, for each frame, a score that represents a voice degree or a music degree of the audio signal based on the calculated feature quantities.

The voice feature quantity detector 51 calculates power spectra by performing Fourier transform on the audio signal Sg on a sub-frame basis and generates a temporal trajectory of the power spectra using power spectra of plural sub-frames. Then, the voice feature quantity detector 51 calculates a modulation spectrum by further performing Fourier transform on the temporal trajectory of the power spectra. The interval determining module 55 determines based on the calculated modulation spectrum whether a power value of the modulation spectrum at a certain modulation frequency is larger than or equal to a certain value (threshold value).

The audio processor 27 performs the above operation on a frame-by-frame basis. If the power value of the modulation spectrum is larger than or equal to the certain value in a certain number or more of frames among P frames, for example, the audio processor 27 determines that the interval of the P frames is a voice interval.

The interval determining module 55 corrects the voice score S1 that is calculated for each frame belonging to an interval that has been determined a voice interval by adding a certain value to it or multiplying it by a certain value.

Figure 5:
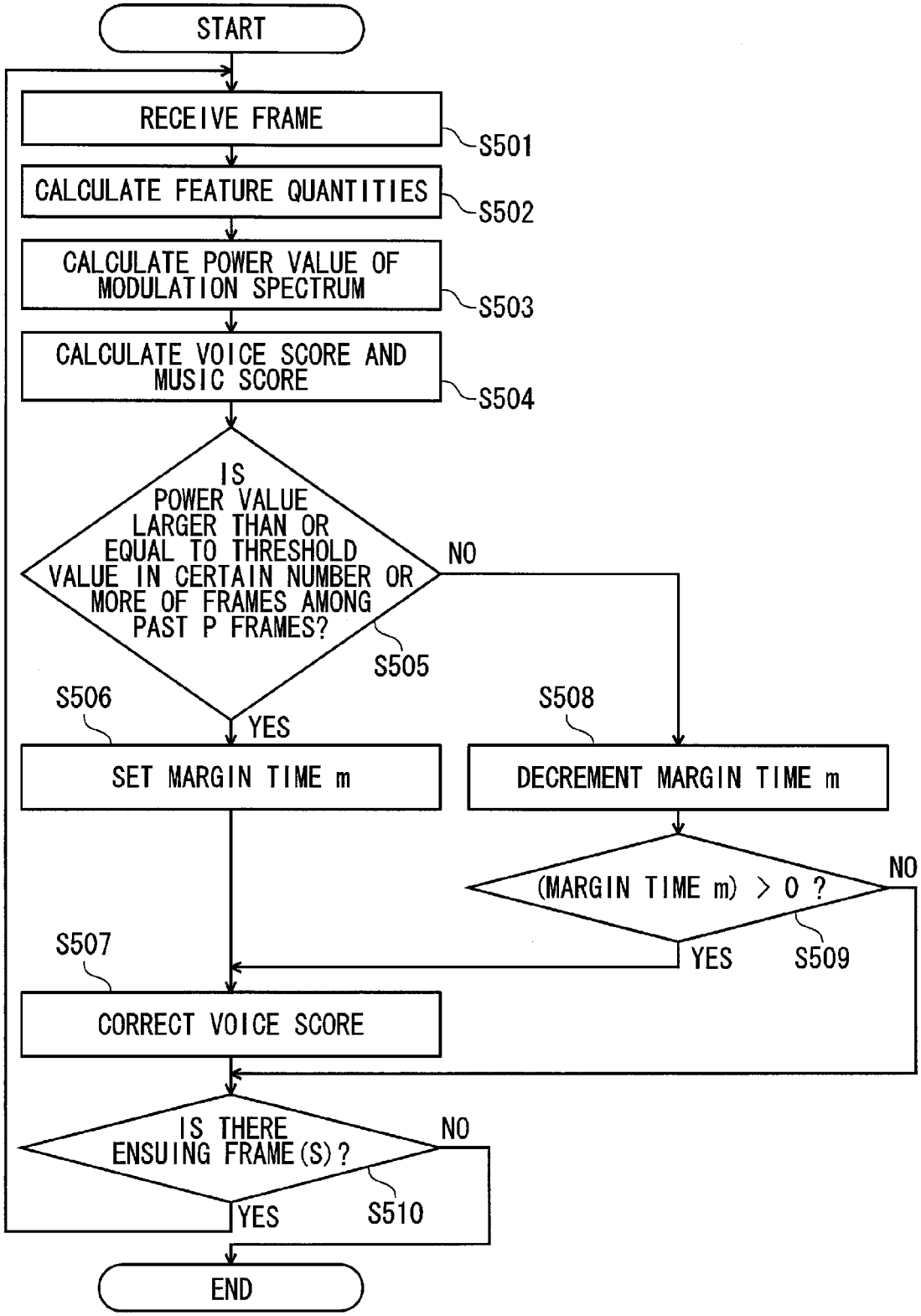
FIG. 5 is a flowchart of a sound quality correction process which is executed by the audio processor of the receiver according to the first embodiment.

Next, a sound quality correction process which is executed by the audio processor 27 will be described with reference to a flowchart of FIG. 5.

First, at step S501, one frame of an audio signal is input to the voice feature quantity detector 51 and the music feature quantity detector 53. At step S502, each of the voice feature quantity detector 51 and the music feature quantity detector 53 calculates feature quantities of the frame. At step S503, the voice feature quantity detector 51 calculates a power value of a modulation spectrum of the frame of the audio signal.

At step S504, the voice degree calculator 52 and the music degree calculator 54 calculate a voice score that represents a voice degree and a music score that represents a music degree of the frame of the audio signal, respectively, based on the calculated feature quantities.

At step S505, the interval determining module 55 determines whether the power value of the modulation spectrum at a certain modulation frequency is larger than or equal to a threshold value in a certain number or more of frames among P consecutive frames. If the number of such frames is larger than or equal to the certain number (S505: yes), the interval determining module 55 sets a certain time m as a margin time at step S506 and corrects the voice score at step S507. Plural threshold values may be used at step S505. In this case, at step S507, the interval determining module 55 the voice score is corrected by a degree that corresponds to the number of threshold values that the power value of the modulation spectrum exceeds or is equal to.

On the other hand, if the number of frames in which the power value of the modulation spectrum is larger than or equal to the threshold value is smaller than the certain number (S505: no), the interval determining module 55 decrements the margin time m at step S508 and determines, at step S509, whether or not the margin time m is larger than 0. If the margin time m is larger than 0 (S509: yes), the process moves to step S507. If the margin time m is equal to 0 (S509: no), the process moves to step S510.

Since the margin time m is set in the above-described manner, it is determined that intervals are consecutive voice intervals, even if the intervals are voice intervals in which voices are often interrupted, for example, such as intervals including dialogues in the drama, etc. The audio signal can thus be corrected so as not to suffer unduly large variations.

If no margin time m is set, the interval determining module 55 does not execute step S508 and determines, at step S508, that the margin time m is equal to 0. At step S508, the interval determining module 55 decrements the margin time m by several tens of milliseconds, for example.

If there is an ensuing frame(s) (S510: yes), the audio processor 27 returns to step S501 and receives the next frame. If there is no ensuing frame (S510: no), the audio processor 27 finishes the execution of the process.

Although in the embodiment the receiver 100 calculates the two scores, that is, the voice score that represents the voice degree and the music score that represents the music degree, the forms of the scores are not limited to the these ones. For example, one score that represents both of the voice degree and the music degree may be employed. Also in this case, the interval determining module 55 corrects the one score according to power values. The interval determining module 55 corrects the score of an interval that is determined a voice interval based on power values of modulation spectra so that the voice degree is increased. The sound quality corrector 57 corrects the audio signal according to the voice degree and the music degree of the received score.

Although in the embodiment the receiver 100 and the display/speaker apparatus 200 are separate apparatus, they may be integrated together as in a TV receiver, for example.

Second Embodiment

Figure 6:
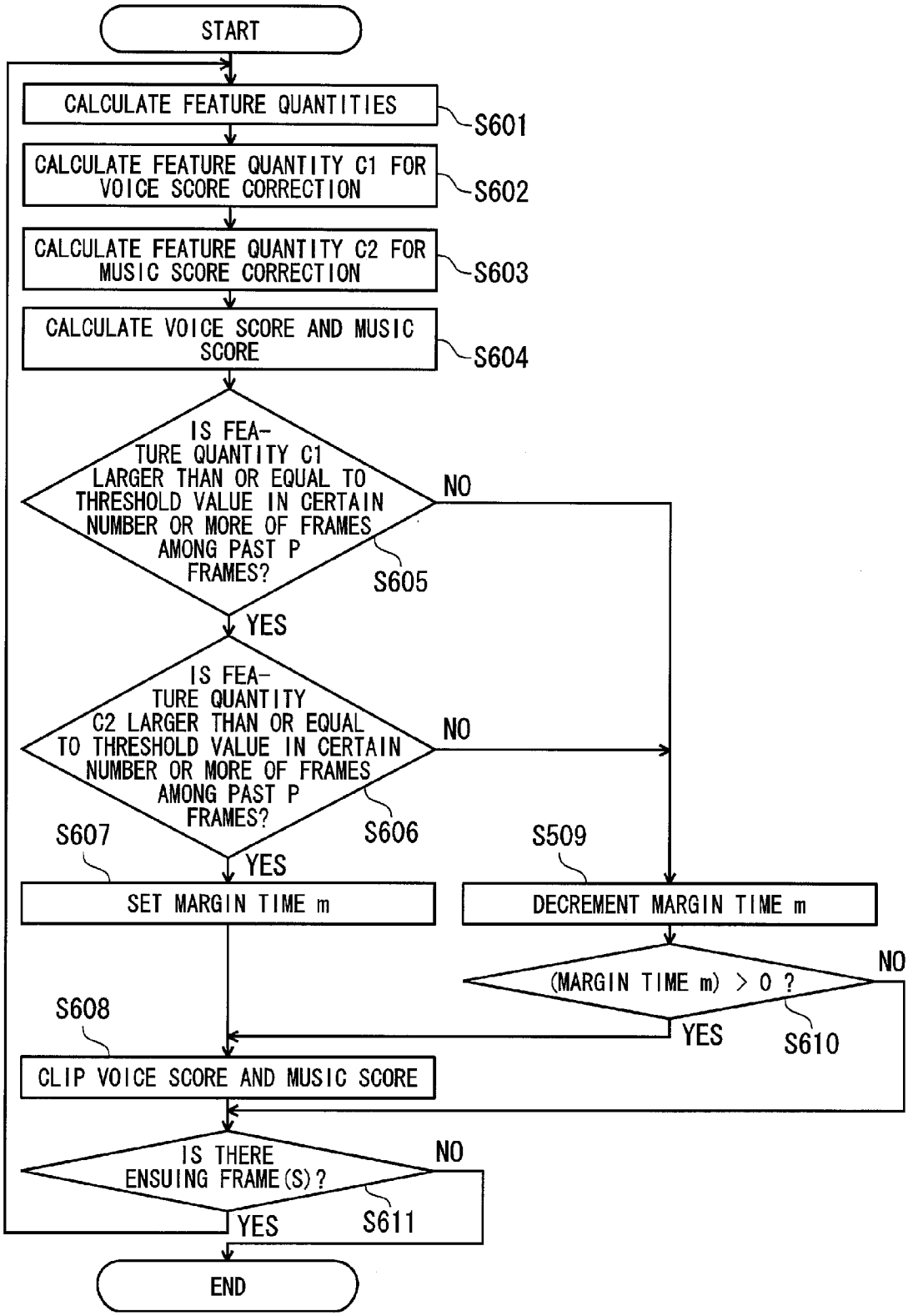
FIG. 6 is a flowchart of a sound quality correction process which is executed by an audio processor of a receiver according to a second embodiment.

A second embodiment will be described below with reference to FIG. 6. As in the first embodiment, a sound quality correcting apparatus according to the second embodiment is a receiver 100*a*. Since the system configuration and the functions of the individual sections etc. are the same in many respects as those of the receiver 100 according to the first embodiment, different functions and a sound quality correction process will mainly be described below.

In the receiver 100 according to the first embodiment, the interval determining module 55 corrects the voice score based on modulation spectra detected by the voice feature quantity detector 51. On the other hand, in the receiver 100*a* according to the second embodiment, the interval determining module 55 corrects the voice score and the music score based on one of feature quantities detected by the voice feature quantity detector 51 and one of feature quantities detected by the music feature quantity detector 53.

First, example functions of the audio processor 27 according to the second embodiment will be described with reference to FIG. 3.

The voice feature quantity detector 51 detects feature quantities in the same manner as in the first embodiment and outputs the detected feature quantities to the voice degree calculator 52. Furthermore, the voice feature quantity detector 51 outputs a feature quantity that is useful for discrimination of a voice interval of an audio signal among the detected feature quantities to the interval determining module 55 as a feature quantity for voice score correction. Although in the embodiment the voice feature quantity detector 51 outputs a power value of a modulation spectrum to the interval determining module 55, any feature quantity may be output to the interval determining module 55 as long as it is useful for discrimination of a voice interval.

Furthermore, the voice degree calculator 52 calculates a voice score based on the received feature quantities.

The music feature quantity detector 53 detects feature quantities, and outputs a feature quantity that is useful for discrimination of a music interval of the audio signal among the detected feature quantities to the interval determining module 55 as a feature quantity for music score correction (a data flow from the music feature quantity detector 53 to the interval determining module 55 is not shown in FIG. 3). The music feature quantity detector 53 outputs, to the interval determining module 55, a feature quantity such as one relating to pitch that strongly reflects a musical sound contained in an audio signal, the feature quantity that is output to the interval determining module 55 is not limited to such a feature quantity.

The music feature quantity detector 53 outputs the detected feature quantities to the music degree calculator 54. The music degree calculator 54 calculates a music score that represents a musical sound degree of the audio signal based on the received feature quantities.

The interval determining module 55 corrects the voice score and the music score based on the received feature quantity for voice score correction and the received feature quantity for music score correction. For example, the interval determining module 55 clips voice score values and music score values calculated in the intervals of P frames if the feature quantity C1 for voice score correction is larger than or equal to a threshold value in a certain number of more of frames among the P frames and if the feature quantity C2 for music score correction is larger than or equal to a threshold value in a certain number of more of frames among the P frames.

The clipping is processing of limiting the voice score or the music score to a medium-value portion of its entire range. More specifically, for example, where the voice score or the music score can take values between a maximum value "1" and a minimum value "0," the clipping corrects each voice score value or music score value to a range of about 0.3 to 0.7. The range to which the clipping limits the voice score or the music score is not limited to such a range, and may be any range as long as it is defined by a value that is larger than a minimum value and a value that is smaller than a maximum value that the voice score or the music score can take.

Next, a sound quality correction process which is executed by the audio processor 27 according to the second embodiment will be described with reference to a flowchart of FIG. 6.

First, when an audio signal is input to the audio processor 27, at step S601 the voice feature quantity detector 51 and the music feature quantity detector 53 calculate feature quantities of one frame of the input audio signal. At step S602, the voice feature quantity detector 51 calculates a feature quantity C1 to be used for voice score correction, such as a power value of a modulation spectrum. At step S603, the music feature quantity detector 53 calculates a feature quantity C2 to be used for music score correction, such as a feature quantity relating to pitch.

At step S604, the voice degree calculator 52 and the music degree calculator 54 calculate a voice score that represents a voice degree or a music score that represents a music degree of the frame, respectively, based on the calculated feature quantities.

At step S605, the interval determining module 55 determines whether the feature quantity C1 for voice score correction is larger than or equal to a threshold value in a certain number or more of frames among P consecutive frames. If the number of such frames is larger than or equal to the certain number (S605: yes), at step S606 the interval determining module 55 determines whether the feature quantity C2 for music score correction is larger than or equal to a threshold value in a certain number or more of frames among the P consecutive frames. If the number of such frames is larger than or equal to the certain number (S606: yes), the interval determining module 55 sets a margin time m at step S607 and clips the voice score and the music score at step S608. At step S608, the interval determining module 55 may clip at least one of the voice score and the music score.

On the other hand, if the number of frames in which the feature quantity C1 or C2 is larger than or equal to the threshold value is smaller than the certain number (S605 or S606: no), the interval determining module 55 decrements the margin time m at step S609 and determines, at step S610, whether or not the margin time m is larger than 0. If the margin time m is larger than 0 (S610: yes), the process moves to step S608. If the margin time m is equal to 0 (S610: no), the process moves to step S611.

If there is an ensuing frame(s) (S611: yes), the audio processor 27 returns to step S601 (the next frame is received). If there is no ensuing frame (S611: no), the audio processor 27 finishes the execution of the process.

According to the first and second embodiments, the receiver 100 or 100*a* can discriminate voice intervals and music intervals of an input audio signal and output an audio signal having proper sound quality in each interval. Furthermore, the receiver 100 or 100*a* can correct each score value calculated based on feature quantities detected from a frame of an audio signal based on feature quantity values such as power values of modulation spectra calculated for plural frames. Therefore, in an interval of an audio signal in which a voice element and a musical sound element exist in mixture, the receiver 100 or 100*a* can prevent unduly large variations of the scores and hence can prevent unduly large variations of the audio signal which is corrected according to the scores.

While certain embodiment has been described, the exemplary embodiment has been presented by way of example only, and is not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sound quality correcting method in an apparatus to which an audio signal is input, comprising:

receiving an input audio signal;

calculating feature quantities of the input audio signal for each of a plurality of intervals having a certain time length and being included to a first interval;

calculating a score value for each of the plurality of first intervals based on the calculated feature quantities;

calculating a power value, at a certain modulation frequency, of a modulation spectrum of the input audio signal; and correcting the score value in each of the plurality of first intervals that belong to a second interval if the power value calculated in the second interval is larger than or equal to a first certain value, and correcting the audio signal based on the corrected score value, wherein a voice score value representing a degree of dominance of a voice component in the audio signal for each of the plurality of first intervals is calculated based on the calculated feature quantities, wherein the voice score value in each of the plurality of first intervals that belong to the second interval is corrected if the power value calculated in the second interval is larger than or equal to the first certain value, and wherein a first correction is performed on the audio signal based on the corrected voice score value.

2. The method of claim 1, wherein the calculating of the power value includes calculating the power value for each of the plurality of first intervals.

3. The method of claim 2, wherein the correcting of the score value in each of the plurality of first intervals is conducted if the second interval includes a certain number or more of the plurality of first intervals in which the calculated power value is larger than or equal to a second certain value.

4. The method of claim 3, wherein correcting of the score value comprises correcting the score values in the first intervals that belong to a third interval that follows the second interval if the second interval includes the certain number or more of the plurality of first intervals in which the calculated power value is larger than or equal to the second certain value, and if the third interval does not include the certain number or more of the plurality of first intervals in which the calculated power value is larger than or equal to the second certain value.

5. The method of claim 1, wherein the calculating of the power value includes calculating a power value of a modulation frequency component of the modulation spectrum, the modulating frequency being included in a modulation frequency band of 2 to 10 Hertz (Hz).

6. The method of claim 1, wherein the calculating of the score value includes calculating a music score value representing a degree of dominance of a musical sound component in the audio signal for each of the plurality of first intervals based on the calculated feature quantities.

7. The method of claim 6, wherein the correcting of the score value comprises correcting the music score value in each of the plurality of first intervals that belong to the second interval if a value of one of the feature quantities calculated in the second interval is larger than or equal to the first certain value, and performing a second correction that is different from the first correction on the audio signal based on the corrected music score value.

8. The method of claim 7, wherein the first correction is performed by a score corrector that is configured to clip the voice score value so that the voice score value falls within a range between a value that is larger than a minimum value of the voice score value and a value that is smaller than a maximum value of the voice score value, if the power value calculated in the second interval is larger than or equal to a first value and the value of the one feature quantity calculated in the second interval is larger than or equal to a second value.

9. The method of claim 7, wherein the second correction is performed by a score corrector that is configured to clip the music score value so that the music score value falls within a range between a value that is larger than a minimum value of the music score value and a value that is smaller than a maximum value of the music score value, if the power value calculated in the second interval is larger than or equal to a first value and the value of the one feature quantity calculated in the second interval is larger than or equal to a second value.

10. The method of claim 1, wherein the receiving of the input audio signal comprises:

tuning to receive a broadcast-wave signal which contains an audio signal, the audio signal being provided to an input module.

11. A sound quality correcting apparatus comprising:

an input module configured to receive an input audio signal;

a feature quantity calculator configured to calculate feature quantities of the input audio signal for each of a plurality of intervals having a certain time length and being included to a first interval;

a score calculator configured to calculate a score value for each of the plurality of first intervals based on the calculated feature quantities;

a modulation spectrum power calculator configured to calculate a power value, at a certain modulation frequency, of a modulation spectrum of the input audio signal;

a score corrector configured to correct score values in ones of the first intervals that belong to a second interval if the power value calculated in the second interval is larger than or equal to a first certain value; and a signal corrector configured to correct the audio signal based on the corrected score values, wherein the score calculator is configured to calculate a voice score value representing a degree of dominance of a voice component in the audio signal for each of the plurality of first intervals based on the calculated feature quantities, wherein the score corrector is configured to correct the voice score value in each of the plurality of first intervals that belong to the second interval if the power value calculated in the second interval is larger than or equal to the first certain value, and wherein the signal corrector is configured to perform a first correction on the audio signal based on the corrected voice score value.

12. The apparatus of claim 11, wherein:

the modulation spectrum power calculator is configured to calculate the power value for each of the plurality of first intervals; and the score corrector is configured to correct the score values in the plurality of first intervals that belong to the second interval if the second interval includes a certain number or more of the plurality of first intervals in which the calculated power value is larger than or equal to a second certain value.

13. The apparatus of claim 12, wherein the score corrector is configured to correct the score values in the first intervals the belong to a third interval that follows the second interval if the second interval includes the certain number or more of the plurality of first intervals in which the calculated power value is larger than or equal to the second certain value, and if the third interval does not include the certain number or more of the plurality of first intervals in which the calculated power value is larger than or equal to the second certain value.

14. The apparatus of claim 11, wherein the modulation spectrum power calculator is configured to calculate a power value of a modulation frequency component of the modulation spectrum, the modulating frequency being included in a modulation frequency band of 2 to 10 Hertz (Hz).

15. The apparatus of claim 11, wherein the score calculator is configured to calculate a music score value representing a degree of dominance of a musical sound component in the audio signal for each of the plurality of first intervals based on the calculated feature quantities, wherein the score corrector is configured to correct the music score value in each of the plurality of first intervals that belong to the second interval if a value of one of the feature quantities calculated in the second interval is larger than or equal to a third certain value, and wherein the signal corrector is configured to perform a second correction that is different from the first correction on the audio signal based on the corrected music score value.

16. The apparatus of claim 15, wherein as the first correction the score corrector is configured to clip the voice score value so that the voice score value falls within a range between a value that is larger than a minimum value of the voice score value and a value that is smaller than a maximum value of the voice score value, if the power value calculated in the second interval is larger than or equal to a first value and the value of the one feature quantity calculated in the second interval is larger than or equal to a second value.

17. The apparatus of claim 15, wherein as the second correction the score corrector is configured to clip the music score value so that the music score value falls within a range between a value that is larger than a minimum value of the music score value and a value that is smaller than a maximum value of the music score value, if the power value calculated in the second interval is larger than or equal to a first value and the value of the one feature quantity calculated in the second interval is larger than or equal to a second value.

18. The apparatus of claim 11 further comprising:

a tuner configured to tune in to a broadcast-wave signal which contains an audio signal, wherein the input module is configured to receive the audio signal contained in the broadcast-wave signal selected by the tuner.

19. The apparatus of claim 11, wherein the feature quality calculator and the modulation spectrum power calculator is configured as a voice feature quantity detector.

20. The apparatus of claim 11, wherein:

the score calculator is configured as a voice degree calculator;

the score corrector is configured as an interval determining module; and the signal corrector is configured as a sound quality corrector.

* * * * *